United States Patent [19]

Palter

[11] 4,073,422

[45] Feb. 14, 1978

[54] TICKET DISPENSER

[75] Inventor: Herman Palter, University Heights, Ohio

[73] Assignee: Service Sequence Systems, Cleveland Heights, Ohio

[21] Appl. No.: 761,717

[22] Filed: Jan. 24, 1977

[51] Int. Cl.[2] ..... B65H 17/26

[52] U.S. Cl. ..... 226/129; 226/134; 226/156

[58] Field of Search ..... 226/127, 128, 129, 132, 226/133, 134, 135, 136, 156

[56] References Cited

U.S. PATENT DOCUMENTS

| | | | |
|---|---|---|---|
| 3,330,207 | 7/1967 | De Man | 226/157 X |
| 3,606,125 | 9/1971 | Tucker | 226/133 X |
| 3,679,113 | 7/1972 | Startzman | 226/127 X |

*Primary Examiner*—Richard A. Schacher

[57] ABSTRACT

A ticket dispenser is provided which includes a housing having a chamber therein for locating a roll of tickets to be dispensed therein. A roller means is provided having gripping means thereon for gripping tickets on the roll of tickets to effect a positive displacement of a ticket from the chamber when said roller means is rotated. An actuating means is provided for effecting rotation of said roller means to thereby dispense the ticket. The actuating means includes a plurality of tabs thereon which are adapted to engage with a plurality of projections disposed on the roller means to sequentially rotate the roller means a first predetermined amount and then positively stop rotation of said roller means in a predetermined first position and then effect rotation of said roller means a second predetermined amount and then positively stop rotation of said roller means in a predetermined second position.

14 Claims, 7 Drawing Figures

FIG. 1
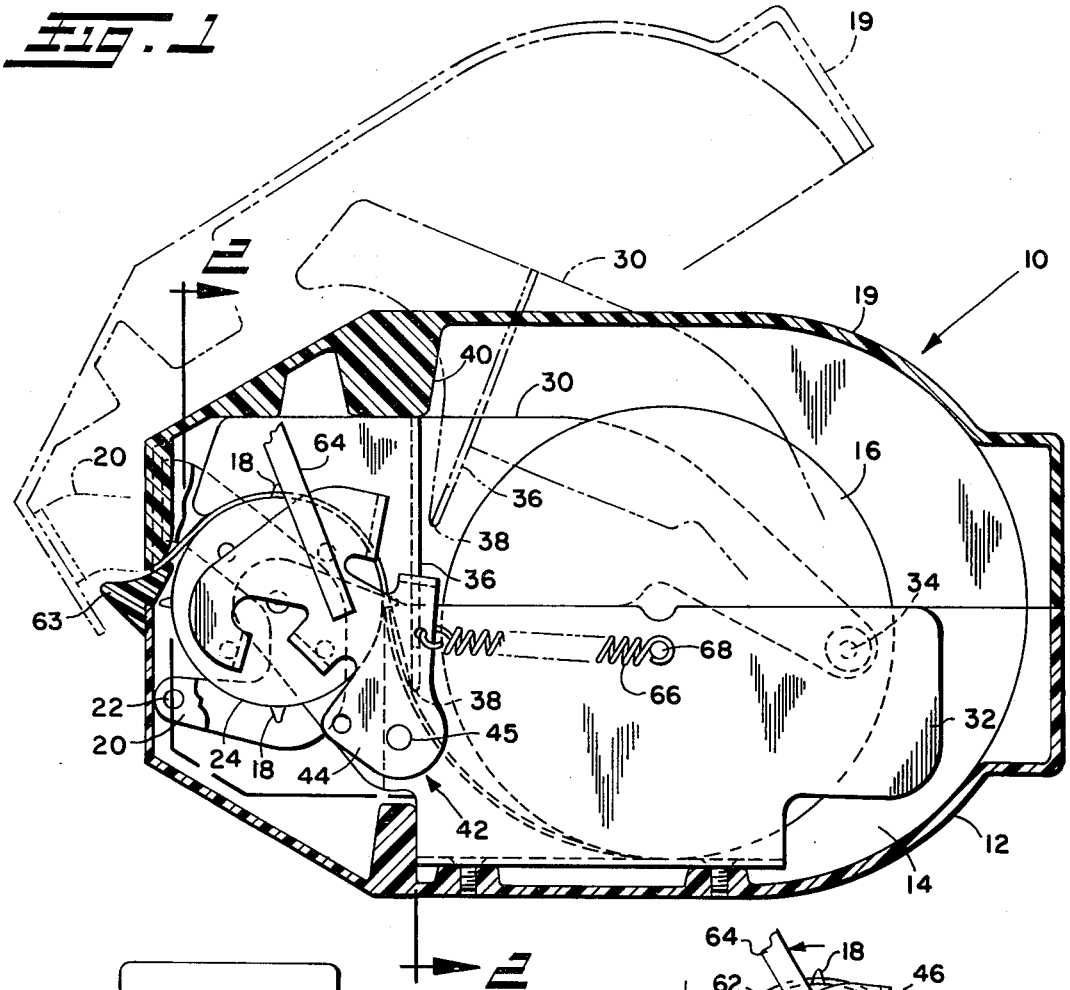
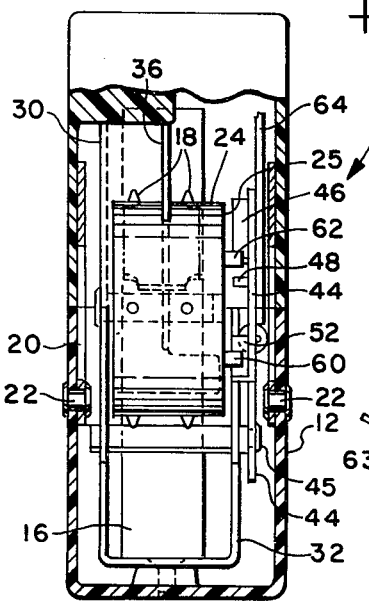
FIG. 2
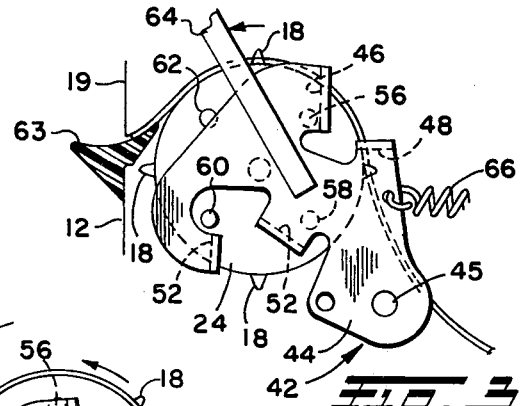
FIG. 3
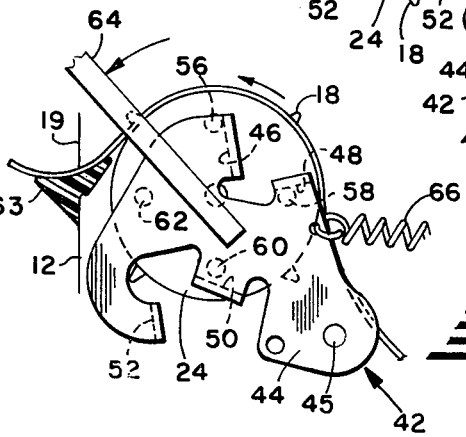
FIG. 4

TICKET DISPENSER

BACKGROUND OF THE PRESENT INVENTION

The present invention relates to an apparatus for dispensing tickets and more particularly to an apparatus which includes a roller means for engaging with tickets to be dispensed and which provides for sequential movement and stopping of said roller means to thereby dispense a ticket and which positively locates the next sequential ticket to be dispensed in a predetermined position in the housing.

Known apparatus for dispensing tickets generally suffers from the disadvantage that the dispensing mechanism is extremely complex in order to provide for positive displacement of a ticket from the dispenser. In a ticket dispenser it is necessary to prohibit a person from grabbing a dispensed ticket and pulling on the ticket to disengage further tickets from the dispensing mechanism. It is necessary to enable one ticket to be dispensed each time the dispensing mechanism is actuated. Other known ticket dispenser has suffered from this problem in that they allow multiple tickets to be dispensed if a person grabs a dispensed ticket and pulls on it. Accordingly, the present invention contemplates a simply constructed ticket dispenser which positively dispenses one ticket each time the ticket mechanism is actuated and which prevents subsequent tickets from being disengaged from the mechanism by the user pulling on the dispensed ticket.

SUMMARY OF THE PRESENT INVENTION

The present invention provides a new and novel ticket dispenser including a housing having a chamber therein for locating a roll of tickets to be dispensed therefrom. The ticket mechanism includes a roller means having a plurality of gripping means thereon for gripping tickets on the roll of tickets to effect a positive displacement of a ticket from the chamber in the housing upon rotation of the roller means. A cyclicable actuating means is provided for effecting rotation of the roller means to dispense the ticket. The ticket dispenser further includes means operatively connected with the roller means and engageable with the actuating means to enable the actuating means to rotate the roller means to dispense a ticket upon movement of the actuating means through a single cycle. The actuating means upon actuation through a single cycle effects rotation of the roller means a first predetermined amount and then positively stops rotation of the roller means in a predetermined position and then effects rotation of the roller means a second predetermined amount and positively stops rotation of the roller means after rotation of the roller means the second predetermined amount.

The present invention provides a new and novel ticket dispenser as set forth in the preceding paragraph wherein the means operatively connected to the roller means includes first, second, third, and fourth projections connected to the roller means and the actuating means includes first, second, third, and fourth tabs connected to the actuating means. The actuating means upon movement through a cycle sequentially effecting engagement of the first tab with the first projection to rotate the roller means a first predetermined amount, effecting engagement of the second tab with the second projection to positively stop the roller means, effecting engagement of the third tab with the third projection to rotate the roller means a second predetermined amount and effecting engagement of the fourth tab with the fourth projection to positively stop the roller means.

The present invention further provides a new and novel ticket dispenser including a housing, a chamber located in the housing for having a roll of tickets to be dispensed located therein, roller means having a plurality of gripping means thereon for gripping tickets on the roll to effect a positive displacement of a ticket from the chamber upon rotation of the roller means and actuating means for effecting rotation of the roller means. The roller means includes stop means disposed thereon for engaging with the actuating means to rotate and position the roller means in a plurality of predetermined positions in response to actuation of the actuating means. The actuating means upon actuation dispensing a ticket by sequentially engaging the stop means to rotate the roller means a first predetermined amount, engaging the stop means to stop the roller means at a first predetermined position after rotating the first predetermined amount, engaging the stop means to rotate the roller means a second predetermined amount and engaging the stop means to stop the roller means at a second predetermined position after rotating the roller means the second predetermined amount.

DESCRIPTION OF THE DRAWINGS

FIG. 1 is a side view of the ticket dispenser of the present invention which illustrates the case in an open position in phantom lines and the guide arm in an up position in phantom lines.

FIG. 2 is a front view of the ticket dispenser of the present invention taken approximately along lines 2—2 of FIG. 1 more fully illustrating the roller construction and the tabs disposed on the actuator means.

FIG. 3 is a side fragmentary view more fully illustrating the roller and actuating means and showing the first tab of the actuating means engaging with the first projection on the roller means upon initial actuation of the actuating means.

FIG. 4 is a side fragmentary view similar to FIG. 3 wherein the second tab of the actuating means engages the second projection of the roller means to stop rotation of the roller means at its first predetermined position.

DESCRIPTION OF THE PREFERRED EMBODIMENT

Figure 5:
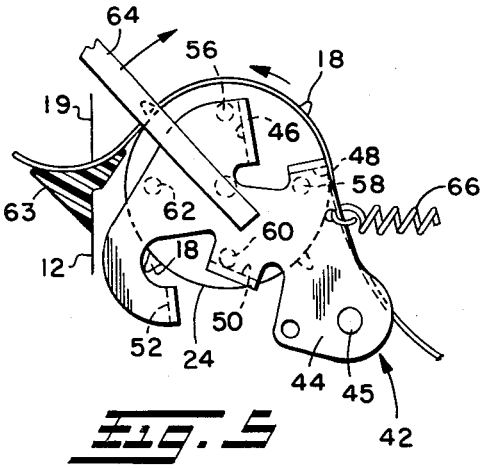
FIG. 5 is a side fragmentary view similar to FIG. 4 showing the actuator means as it initially starts to complete its return cycle under the influence of the spring means and wherein the third tab of the actuating means engages with the third projection on the roller means.
Figure 6:
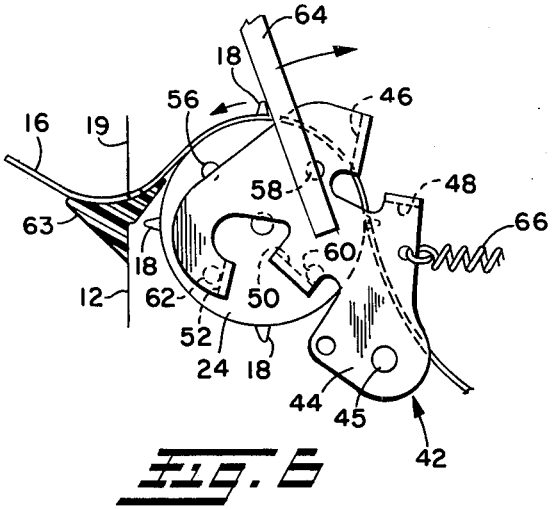
FIG. 6 is a side fragmentary view similar to FIG. 5 showing the actuating means completing its first cycle under the influence of the spring means and wherein the fourth tab on the actuating means engages the fourth projection on the roller means to positively stop the roller means at its second predetermined position.

Referring to the drawings and more particularly FIG. 1 a ticket dispenser 10 is illustrated. The ticket dispenser 10 includes a housing 12 which defines a chamber 14 in which a roll of tickets 16 is disposed. The housing 12 includes a cover 19 which is secured to the hinge member 20. The hinge member 20 is secured at its opposite end to a pivotable connection 22 which is connected to the bottom portion of the housing 12. The hinge 20 enables the cover 19 to be moved to its phantom line position as illustrated in FIG. 1 to place a roll of tickets 16 in the chamber 14 disposed in the housing 12.

A roller means 24 is provided for dispensing the tickets 16 from the chamber 14 in the housing. The roller means includes a plurality of gripping means 18 disposed thereon which engage with holes disposed in the separation line between adjacent tickets. When the tickets pass over the roller means 24 the grippers 18 pass through the openings in the tickets to provide for positive displacement of the tickets upon rotation of the roller means 24. A guide arm 30 is pivotably connected to a side plate 32 of the dispenser mechanism at the pivot point 34. The arm 30 when in its downward position as is illustrated in full lines in FIG. 1 provides a guide for the tickets 16 as they pass from the roll to the roller means 24. The arm 30 includes a member 36 which has a guide surface 38 disposed thereon. The guide surface 38 of the arm 30 engages the tickets as they pass from the roll and around the periphery of the roller means 24 and causes the tickets to substantially wrap around the roller means 24. This enables at least two gripping projections 18 to be engaged with the tickets as they are dispensed at all times by providing substantially more contact between the tickets and the roller means 24 then if the guide surface 38 were not present. Thus, the guide arm 30 provides firm engagement of the tickets 16 with the grippers 18 disposed on the roller means 24 to prohibit a user from pulling tickets out of the housing 12 without effecting rotation of the roller means 24. When the cover 18 of the housing 12 is in its closed position as is illustrated in full lines in FIG. 1 a member 40 formed intricately with the cover 18 engages the upper surface of the arm 30 to positively position the arm 30 in its full line position illustrated in FIG. 1.

An actuating mechanism 42, more fully illustrated in FIGS. 3–6 is provided for effecting rotation of the roller means 24 and the displacement of a ticket from the housing 12. The actuating means 42 includes an actuating plate 44 which is pivotably connected at the pivot point 45 to the side plate 32 of the dispenser mechanism. The actuating plate 44 is pivotable in a counterclockwise direction as viewed in FIG. 3 by an actuating handle 64 which is connected in a well-known manner to the actuating plate 44. A spring means in the form of a coil spring 66 is connected at one end to the actuating plate 44 and at the other end to a suitable post 68 secured to the side plate 32. The spring 66 is in tension and biases the actuating plate 44 in a clockwise direction about the pivot point 45.

The actuating plate 44 includes first, second, third, and fourth tabs 46, 48, 50, and 52, respectively, thereon for effecting rotation of the roller means 24. The roller means 24 includes an end surface 25 thereon which includes first, second, third, and fourth projections 56, 58, 60 and 62, respectively. The projections 56–62 are disposed so as to engage with the tabs 46–52 upon rotation of the actuating plate 44 to effect rotation of the roller means 24.

As is more specifically illustrated in FIG. 3, actuation of the actuating means 42 is effected by a user engaging the handle 64 and rotating the handle 64 in a counterclockwise direction against the biasing force of the spring 66. As the handle 64 and actuating plate 44 are initially rotated in a counterclockwise direction the first tab 46 on the actuating plate engages the first projection 56 on the roller means 24 to start rotation of the roller means 24 in a counterclockwise direction. As can be viewed in FIG. 3 this causes a ticket 16 to start to come out of the dispensing mechanism 12. Further rotation of the handle 64 against the biasing force of spring 66 cause the roller means 24 to rotate a first predetermined amount until the second tab 48 engages with the second projection 58 disposed on the roller means 24 as is illustrated in FIG. 4. Engagement of the tab 48 with the projection 58 will positively stop rotation of the roller means 24 in a first predetermined position after the roller means 24 has rotated the first predetermined amount. At this point in time the ticket will be approximately halfway out as is illustrated in FIG. 4.

The handle 64 is then released and the spring 66 effects rotation of the actuating plate 44 in a clockwise direction. Rotation of the actuating plate 44 in a clockwise direction will effect engagement of the third tab 50 with the third projection 60 disposed on the roller means 24 as is illustrated in FIG. 5. The action of the spring 66 and the clockwise rotation of the actuating plate 44 about the pivot point 45 will cause the tab 50 to engage the projection 60 to effect a further counterclockwise rotation of the roller means 24. At this point in time the ticket will be approximately $\frac{3}{4}$ of the way out of the dispenser. The roller means 24 will continue to rotate in a counterclockwise direction until the roller means 24 has rotated a second predetermined amount. At this point the fourth tab 52 disposed on the actuating plate 44 will engage with the fourth projection 62 disposed on the roller 24. Engagement of the tab 52 with the projection 62 will positively stop rotation of the roller means 24 at a second predetermined position as is viewed in FIG. 6. In this position the ticket will be fully dispensed and the next sequential ticket to be dispensed will be positioned in the ticket dispenser 12. A lip 63 has been provided to guide the tickets as they are dispensed from the mechanism. The lip 63 prevents tickets 16 from being drawn straight out in a direction tangential to the roller means 24 by providing an upwardly curved surface to direct the dispensed ticket. This insures that the ticket 16 will be ripped off from the lip 63 one at the time rather than be drawn in a tangential direction where it may sometimes be possible to draw the dispensed ticket and the next sequential ticket to be dispensed simultaneously. Thus, it should be appreciated that the lip 63 cooperating with the gripping means 18 to prevent more than one ticket from being dispensed each time the mechanism is actuated.

It should be appreciated that the actuating mechanism 42 cooperates with the projections 56–62 disposed on the roller means 24 to positively dispense a ticket 16. The actuating mechanism 42 first rotates the roller means 24 a first predetermined amount and then stops the roller means 24 in a first predetermined position when the handle 64 is rotated in a counterclockwise direction by a user. The roller means 24 is then further rotated a second predetermined amount and then stopped by the actuating mechanism 42 in a second predetermined position when the handle 64 is released and the actuating mechanism 42 rotates in a clockwise direction under the influence of the spring 66. This operation provides for a positive displacement of a ticket to be dispensed and also positively locates the next sequential ticket to be dispensed in a predetermined position. Moreover, it should be appreciated that the positive rotation and stopping of the roller means 24 positively locates the tickets to be dispensed and the next sequential ticket to be dispensed in predetermined locations while prohibiting further tickets from being extracted from the dispenser mechanism 12 by a user pulling on tickets which are partially out of the dispensed mechanism.

Figure 7:
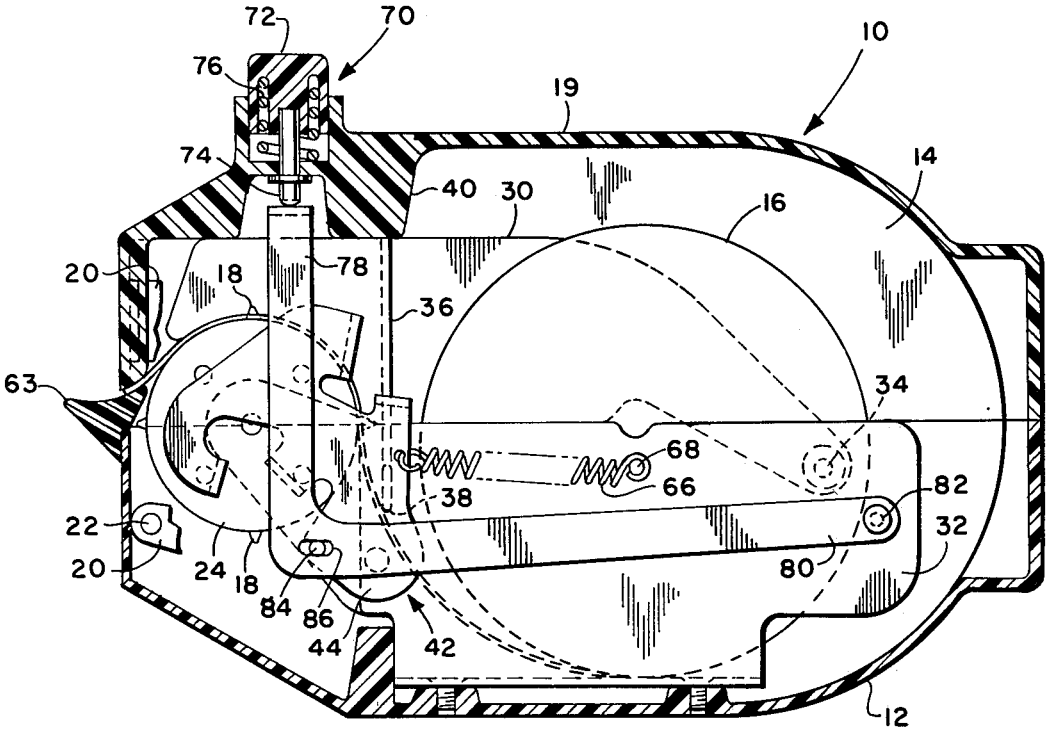
FIG. 7 is a side view of another embodiment of the present invention wherein a push button actuator is utilized to effect actuation of the actuating means.

A further embodiment of the present invention is illustrated in FIG. 7. In the embodiment shown in FIG. 7 the dispensing mechanism 12 and the actuating mechanism 42 is identical to that illustrated previously and like numerals have been utilized to indicate like parts with the exception that instead of the handle 64 being provided to effect rotation of the actuating plate 44 a push button mechanism 70 is provided to effect rotation of the actuating plate 44 in a counterclockwise direction. To this end a push button 72 is provided which engages with a push button rod 74. The push button 72 is urged to its nonactuated position by a spring 76. The push button rod 74 engages one end of an L-shaped arm 78 which has its opposite end 80 pivotably connected at the pivot point 82 to the side plate 32 of the dispenser 12. When the push button 72 is pressed the push button rod 74 will move in a downwardly direction as viewed in FIG. 7. The downward movement of the push rod 74 will cause the arm 78 to rotate about the pivot point 82 in a counterclockwise direction. The actuating plate 44 is connected to the arm 78 by a pin 84 which is connected to the actuating plate 44 and which extends through a slot 86 in the arm 78.

When push button 72 is depressed the arm 78 will rotate in a counterclockwise direction about the pivot point 82 and the slot 86 will also rotate in a counterclockwise direction about the pivot point 82. Rotation of the slot 86 will cause the rod 84 attached to the actuating plate 44 to move in a downwardly direction and to the right as viewed in FIG. 7. This will cause the actuating plate 44 to which the rod 84 is attached to move in a manner analogous to that in which it moves when the handle 64 is rotated from its nonactuated to its actuated position as is illustrated in FIGS. 3 and 4 to start dispensing of a ticket. When the push button 72 is released the spring 76 connected to the push button 72 will release the push button 72 and the spring 66 will rotate the actuating plate in a clockwise direction to its nonactuated position to dispense a ticket. Rotation of the actuating plate under the influence of spring 66 will return arm 78 to its nonactuated position via the pin 84 and the slot 86.

From the foregoing, it should be apparent that a new and improved ticket dispenser mechanism has been provided. The ticket dispenser mechanism includes a housing having a chamber therein for locating a roll of tickets to be dispensed therein. A roller means having a plurality of gripping means thereon is disposed in the housing for gripping tickets on the roll of tickets to effect a positive displacement of a ticket from the chamber in the housing upon actuation of the ticket dispenser. A cyclicable actuating means has also been provided for effecting rotation of the roller means to thereby effect dispensing a ticket. The roller means includes a plurality of projections thereon which are engageable with the actuating means to enable the actuating means to rotate the roller means to dispense a ticket. The actuating means upon movement through a single cycle effects rotation of the roller means a first predetermined amount and then positively stops rotation of the roller means in a first predetermined position and then sequentially effects rotation of the roller means a second predetermined amount and then positively stops rotation of the roller means in a second predetermined position. Such a construction provides a simple ticket dispenser which provides for positive displacement of a ticket from the dispensing mechanism and which positively locates the next sequential ticket to be dispensed therein.

What I claim is:

1. A ticket dispenser comprising a housing, said housing including a chamber therein for locating a roll of tickets to be dispensed therein, roller means having a plurality of gripping means thereon for gripping tickets on the roll of tickets to effect a positive displacement of a ticket from said chamber in said housing upon rotation of said roller means, cyclicable actuating means for effecting rotation of said roller means to thereby dispense the ticket, and means operatively connected to said roller means and engageable with said actuating means to enable said actuating means to rotate said roller means to dispense a ticket upon movement of said actuating means through a single cycle, said actuating means upon movement through a single cycle effecting rotation of said roller means a first predetermined amount and then positively stopping said roller means in a predetermined position and then effecting rotation of said roller means a second predetermined amount and then positively stopping rotation of said roller means, said means operatively connected to said roller means including a plurality of projections operatively connected to said roller means for rotation therewith and said actuating means includes a plurality of tabs for sequentially engaging said plurality of projections upon movement of said actuating means through a cycle to effect rotation of said roller means a first predetermined amount and then positively stop rotation of the roller means in a predetermined position and then effect rotation of said roller means a second predetermined amount and then positively stop rotation of said roller means.

2. A ticket dispenser as defined in claim 1 wherein said plurality of projections include first, second, third, and fourth projections connected to said roller means and said plurality of tabs include first, second, third, and fourth tabs connected to said actuating means, said actuating means upon movement through a cycle sequentially effecting engagement of said first tab with said first projection to rotate said roller means said first predetermined amount, effecting engagement of said second tab with said second projection to positively stop said roller means, effecting engagement of said third tab with said third projection to rotate said roller means said second predetermined amount and effecting engagement of said fourth tab with said fourth projection to positively stop said roller means.

3. A ticket dispenser as defined in claim 2 wherein said actuating means is pivotably disposed relative to said roller means and is pivotable from a nonactuated position to an actuated position to sequentially effect engagement of said first and second tabs with said first and second projections and further including spring means for biasing said actuating means toward said nonactuated position, said spring means acting to return said actuating means to said nonactuated position when said actuating means is moved to said actuated position to effect engagement of said third and fourth tabs with said third and fourth projections upon movement of said actuating means from said actuated position to said nonactuated position.

4. A ticket dispenser as defined in claim 3 further including guide means for engaging with the tickets to be dispensed from said housing for biasing the tickets as they pass from a roll of tickets disposable in said housing into engagement with said roller means to insure engagement of the tickets to be dispensed with said gripping means disposed on said roller means.

5. A ticket dispenser as defined in claim 3 wherein each of said plurality of tabs includes engaging surfaces thereon for engaging with said plurality of projections operatively connected to said roller means with said engaging surface on said first tab being disposed substantially perpendicular to said engaging surface on said second tab and said engaging surface on said third tab being disposed substantially perpendicular to said engaging surface on said fourth tab.

6. A ticket dispenser as defined in claim 3 wherein said projections operatively connected to said roller means are disposed on an end surface of said roller means and project parallel to the axis of rotation of said roller means, each of said plurality of projections being spaced equal distance from the axis of rotation of said roller means and each of said plurality of projections being angularly spaced apart approximately 90° about said end surface of said roller means.

7. A ticket dispenser as defined in claim 5 wherein said projections operatively connected to said roller means are disposed on an end surface of said roller means and project parallel to te axis of rotation of said roller means, each of said plurality of projections being spaced equal distance from the axis of rotation of said roller means and each of said plurality of projections being angularly spaced apart approximately 90° about said end surface of said roller means.

8. A ticket dispenser comprising a housing, said housing including a chamber therein for locating a roll of tickets to be dispensed therein, roller means having a plurality of gripping means thereon for gripping tickets on the roll to effect a positive displacement of a ticket from said chamber in said housing upon rotation of said roller means, actuating means for effecting rotation of said roller means to thereby dispense tickets and stop means disposed on said roller means and engageable with said actuating means to rotate and positively position said roller means in a plurality of predetermined positions in response to actuation of said actuating means, said actuating means upon actuation dispensing a ticket by sequentially engaging said stop menas to rotate said roller means a first predetermined amount, engaging said stop means to stop said roller means at a first predetermined position after rotating said first predetermined amount, engaging said stop means to rotate said roller means a second predetermined amount and engaging said stop means to stop said roller means at a second predetermined position after rotating said second predetermined amount.

9. A ticket dispenser as defined in claim 8 wherein said stop means disposed on said roller means includes a plurality of projections disposed on an end surface of said roller means for rotation therewith and said actuating means includes a plurality of tabs for sequentially engaging said plurality of projections upon movement of said actuating means through a cycle to effect rotation of said roller means said first predetermined amount and then positively stop rotation of said roller means in said first predetermined position and then effect rotation of said roller means said second predetermined amount and then positively stop rotation of said roller means in said second predetermined position.

10. A ticket dispenser as defined in claim 9 wherein said plurality of projections include first, second, third, and fourth projections disposed on an end surface of said roller means, said projections projecting parallel to the axis of rotation of said roller means, and said plurality of tabs include first, second, third, and fourth tabs connected to said actuating means, said actuating means upon movement through a cycle sequentially effecting engagement of said first tab with said first projection to rotate said roller means said first predetermined amount, effecting engagement of said second tab with said second projection to positively stop said roller means at said first predetermined position, effecting engagement of said third tab with said third projection to rotate said roller means said second predetermined amount and effecting engagement of said fourth tab with said fourth projection to positively stop said roller means at said second predetermined position.

11. A ticket dispenser as defined in claim 10 wherein said actuating means is pivotably disposed relative to said roller means and is pivotable from a nonactuated position to an actuated position to sequentially effect engagement of said first and second tabs with said first and second projections and further including spring means for biasing said actuating means toward said nonactuated position, said spring means acting to return said actuating means to said nonactuated position when said actuating means is moved to said actuated position to effect engagement of said third and fourth tabs with said third and fourth projections upon movement of said actuating means from said actuated position to said nonactuated position.

12. A ticket dispenser as defined in claim 8 further including guide means for engaging with the tickets to be dispensed from said housing for biasing the tickets as they pass from a roll of tickets disposable in said housing into engagement with said roller means to insure engagement of the tickets to be dispensed with said gripping means disposed on said roller means.

13. A ticket dispenser as defined in claim 10 wherein each of said plurality of tabs includes engaging surfaces thereon for engaging with said plurality of projections, said engaging surface on said first tab being disposed substantially perpendicular to said engaging surface on said second tab and said engaging surface on said third tab being disposed substantially perpendicular to said engaging surface on said fourth tab.

14. A ticket dispenser as defined in claim 10 wherein each of said projections are spaced equal distance from the axis of rotation of said roller means and each of said first, second, third and fourth projections are angularly spaced apart approximately 90° about said end surface of said roller means.

* * * * *